US007222818B2

(12) United States Patent
Couchey et al.

(10) Patent No.: US 7,222,818 B2
(45) Date of Patent: May 29, 2007

(54) SHIPPING SPOOL

(75) Inventors: Brian P. Couchey, Inman, SC (US); Victor J. DesRosiers, Kinderhook, NY (US)

(73) Assignee: Sonoco Development, Inc., Hartsville, SC (US)

( * ) Notice: Subject to any disclaimer, the term of this patent is extended or adjusted under 35 U.S.C. 154(b) by 72 days.

(21) Appl. No.: 10/971,277

(22) Filed: Oct. 22, 2004

(65) Prior Publication Data

US 2006/0086863 A1 Apr. 27, 2006

(51) Int. Cl.
*B65H 75/14* (2006.01)

(52) U.S. Cl. ..... 242/614; 242/611; 242/912

(58) Field of Classification Search ..... 242/118.7, 242/188, 613, 600, 611, 614, 587.1, 587.2, 242/587, 614.1, 118.6, 118.61, 611.1, 912, 242/608, 118.4, 899, 344
See application file for complete search history.

(56) References Cited

U.S. PATENT DOCUMENTS 757,622 A 4/1904 James
2,650,770 A * 9/1953 Crooks ..... 242/597.6
2,693,323 A 11/1954 Jarmicki
2,990,133 A 6/1961 Tucker, Jr.
D204,970 S 5/1966 Conway et al.
3,591,103 A 7/1971 Hafner et al.
3,606,195 A 9/1971 Freeman, Jr. et al.
3,680,809 A 8/1972 Blackmer et al.
3,743,208 A 7/1973 Schmitz
3,743,209 A 7/1973 Anderson
3,822,841 A 7/1974 Campbell
3,827,651 A 8/1974 Benson et al.
3,840,193 A * 10/1974 Feichtinger et al. ..... 242/597.3
3,940,086 A 2/1976 Stoquelet
3,942,741 A 3/1976 Hussar et al.
4,077,586 A 3/1978 Thomas et al.
4,194,705 A 3/1980 Spirig
4,445,649 A 5/1984 Yataki et al.
D281,482 S 11/1985 Suzuki
4,895,316 A 1/1990 Salloum
4,997,142 A 3/1991 Grant
5,004,179 A 4/1991 Salloum
5,035,355 A * 7/1991 Dollhopf ..... 228/104
D327,637 S 7/1992 Sanchez
5,236,145 A 8/1993 Floury et al.
5,308,011 A 5/1994 Roman
5,383,626 A 1/1995 Häfner
5,474,254 A 12/1995 Faulkner
D390,093 S 2/1998 Spear et al.
5,897,075 A 4/1999 Elder et al.
5,908,172 A 6/1999 Pierro et al.
5,971,317 A * 10/1999 Jaros ..... 242/614
6,036,138 A 3/2000 Sexton et al.

(Continued)

*Primary Examiner*—Patrick Mackey
*Assistant Examiner*—William E. Dondero
(74) *Attorney, Agent, or Firm*—DLA Piper US LLP

(57) ABSTRACT

A spool is provided having opposing identical end flanges coupled to a central barrel. An annular rim portion of the flanges is provided with a plurality of openings positioned at different radial and circumferential positions. The openings are sized such that if the openings were rotated into angular alignment, the openings would span the annular rim portion from an inner radius to an outer radius. The openings thus allow a user to view contents of the spool. Each flange may further provide a generally semi-circularly shaped recess sized and shaped to receive a winding dog.

16 Claims, 4 Drawing Sheets

U.S. PATENT DOCUMENTS 6,065,716 A * 5/2000 Munster ..... 242/597.6
6,138,942 A * 10/2000 DesRosiers et al. ..... 242/614.1
6,598,825 B2 7/2003 Ripplinger
6,715,710 B1 4/2004 Russell et al.
2003/0197087 A9 10/2003 Cox et al.

* cited by examiner

SHIPPING SPOOL

FIELD OF THE INVENTION

The invention relates to spools or reels upon which filaments including monofilaments such as wire, cable, or the like may be wound.

BACKGROUND OF THE INVENTION

It is known to provide spools or reels upon which filaments, including monofilaments such as wire, rope, or cable may be wound for subsequent shipment, storage, and use. Such reels typically include a central barrel connected to opposing end flanges. It is further known to provide a plurality of openings in the end flanges. For example, U.S. Pat. No. 3,942,741 (Hussar et al.) discloses a reel having flanges with a plurality of openings provided to reduce the amount of material used to fabricate the end flanges and to facilitate visual determination of the reel contents (the openings forming a plurality of view ports).

It is still further known to provide one or more dog holes adapted to receive a winding dog of a winding machine used to rotate the spool. For example, U.S. Pat. No. 6,715,710 (Russell et al.) discloses a cable reel having a such a dog hole.

A need exists for a reel which provides a novel arrangement of openings in the reel flange to provide visual access to the reel contents while also providing the flange with desirable structural stiffness characteristics. A further need exists for a reel having a novel dog hole design which receives a winding dog while maintaining a high level of structural rigidity. A reel combining these features would be particularly desirable.

SUMMARY OF THE INVENTION

In a first aspect, the invention is a spool comprising a barrel having a first end, a second end, a longitudinal centerline and an outer surface located at a first radius from the centerline. The spool further comprises first and second end flanges each having a hub portion and an annular rim portion. The annular rim portion has a radial span extending from an inner radius to an outer radius, the inner and outer radii each extending from a flange centerline. The inner radius is substantially equal to the first radius and each flange is fixedly coupled at the hub portion to the barrel at the first and second ends, respectively. A plurality of openings are each positioned at a different angular and radial location within the annular rim portion and have a size such that if the plurality of openings were rotated into angular alignment, the openings would extend over substantially the entire radial span of the annular rim portion.

Preferably, four openings are provided and are positioned at angular locations spaced approximately 90 degrees apart. Each of the first and second flanges may further have a first face and a second face. A circumferential rib may be fixed to the annular rim portion on the first face and extend around the annular rim portion proximate an outer circumference of the annular rim portion. A circumferential wall may be provided, connecting the hub portion to the annular rim portion. A first plurality of radial ribs may be fixed to the annular rim portion, the circumferential wall and the circumferential rib on the first face, extending between the circumferential wall and the circumferential rib. The hub portion may include a central arbor hole formed within an arbor sleeve and a second plurality of radial ribs located on the second face and fixed to the hub portion, arbor sleeve, and circumferential wall, extending between the arbor sleeve and the circumferential wall. Preferably, each flange is fabricated from a polymeric material and the hub portion and the annular rim portion each have a wall thickness in the range of 0.10 to 0.14 inches, the first plurality of radial ribs includes a total of twenty radial ribs, the second plurality of radial ribs includes a total of eight radial ribs, and each flange has an outer diameter of approximately 14 inches.

In a second aspect, the invention is a spool comprising a barrel having a first end and a second end. First and second end flanges are coupled to the barrel first and second ends, respectively. Each flange has a hub portion and a radially-extending, annular rim portion, a first face and a second face. A circumferential rib is fixed to the annular rim portion on the first face and extends around the annular rim portion proximate an outer circumference of the annular rim portion. A circumferential wall connects the hub portion to the annular rim portion. A plurality of radial ribs are fixed to the annular rim portion, the circumferential wall and the circumferential rib on the first face, extending between the circumferential wall and the circumferential rib. An opening is located within the annular rim portion and has a size extending substantially between the circumferential wall and the circumferential rib. A substantially transparent window is connected to the opening.

In a third aspect, the invention is a spool comprising a barrel having a first end and a second end. First and second end flanges are coupled to the barrel first and second ends, respectively, and each flange has a hub portion and a radially-extending, annular rim portion, as well as a first face and a second face. A circumferential rib is fixed to the annular rim portion on the first face and extends around the annular rim portion proximate an outer circumference of the annular rim portion. A circumferential wall connects the hub portion to the annular rim portion. A first plurality of radial ribs is fixed to the annular rim portion, the circumferential wall and the circumferential rib on the first face, extending between the circumferential wall and the circumferential rib. At least a sector of the annular rim portion is fabricated from a substantially transparent polymeric material.

In yet a fourth aspect, the invention is a spool for use with a winding machine having a winding dog to rotate the spool. The spool comprises a barrel having a first end and a second end. First and second end flanges are coupled to the barrel first and second ends, respectively. Each flange has a hub portion and a radially-extending, annular rim portion, as well as a first face and a second face. A circumferential rib is fixed to the annular rim portion on the first face and extends around the annular rim portion proximate an outer circumference of the annular rim portion. A circumferential wall connects the hub portion to the annular rim portion. A first plurality of radial ribs are fixed to the annular rim portion, the circumferential wall and the circumferential rib on the first face, extending between the circumferential wall and the circumferential rib. A generally semi-circularly shaped recess is located between two adjacent radial ribs, proximate the intersection of the ribs and the hub. The semi-circular recess has a center positioned in the range of 2.2 to 2.4 inches from the flange centerline and is adapted to receive the winding dog.

BRIEF DESCRIPTION OF THE DRAWINGS

For the purpose of illustrating the invention, there is shown in the drawings a form of the invention which is presently preferred; it being understood, however, that this invention is not limited to the precise arrangements and instrumentalities shown. In the drawings.

DETAILED DESCRIPTION OF THE DRAWINGS

Figure 1:
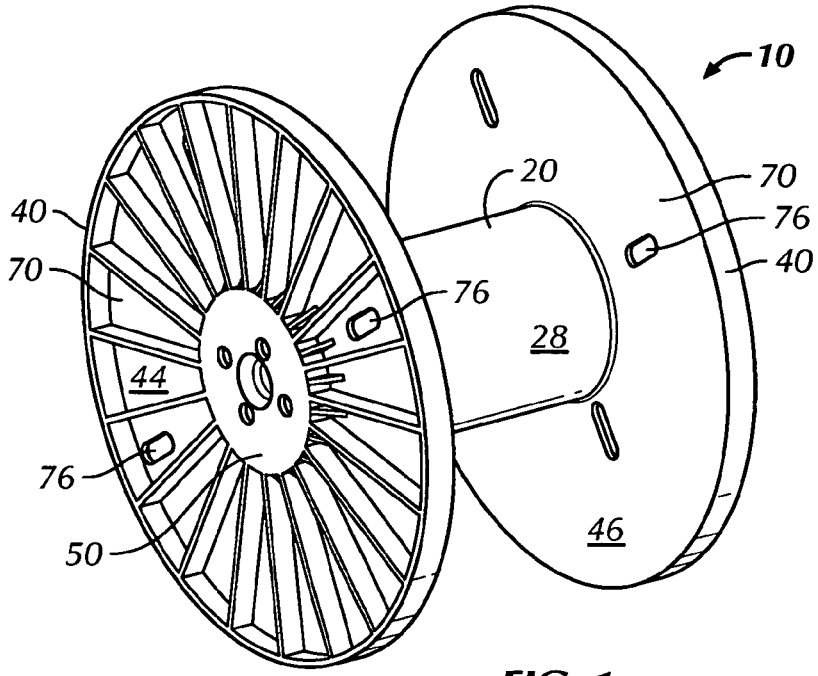
FIG. 1 is a perspective view of a shipping spool in accordance with a preferred embodiment of the present invention.
Figure 2:
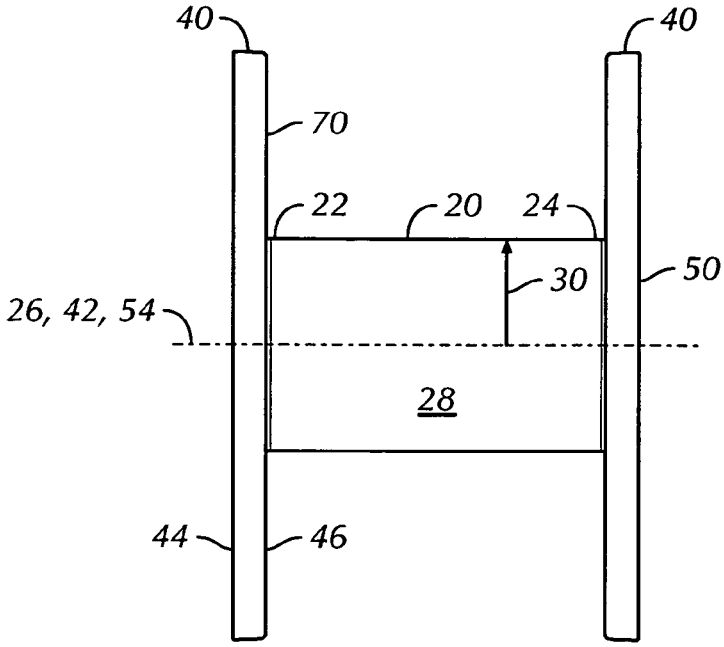
FIG. 2 is an elevational end view of the shipping spool of FIG. 1.
Figure 3:
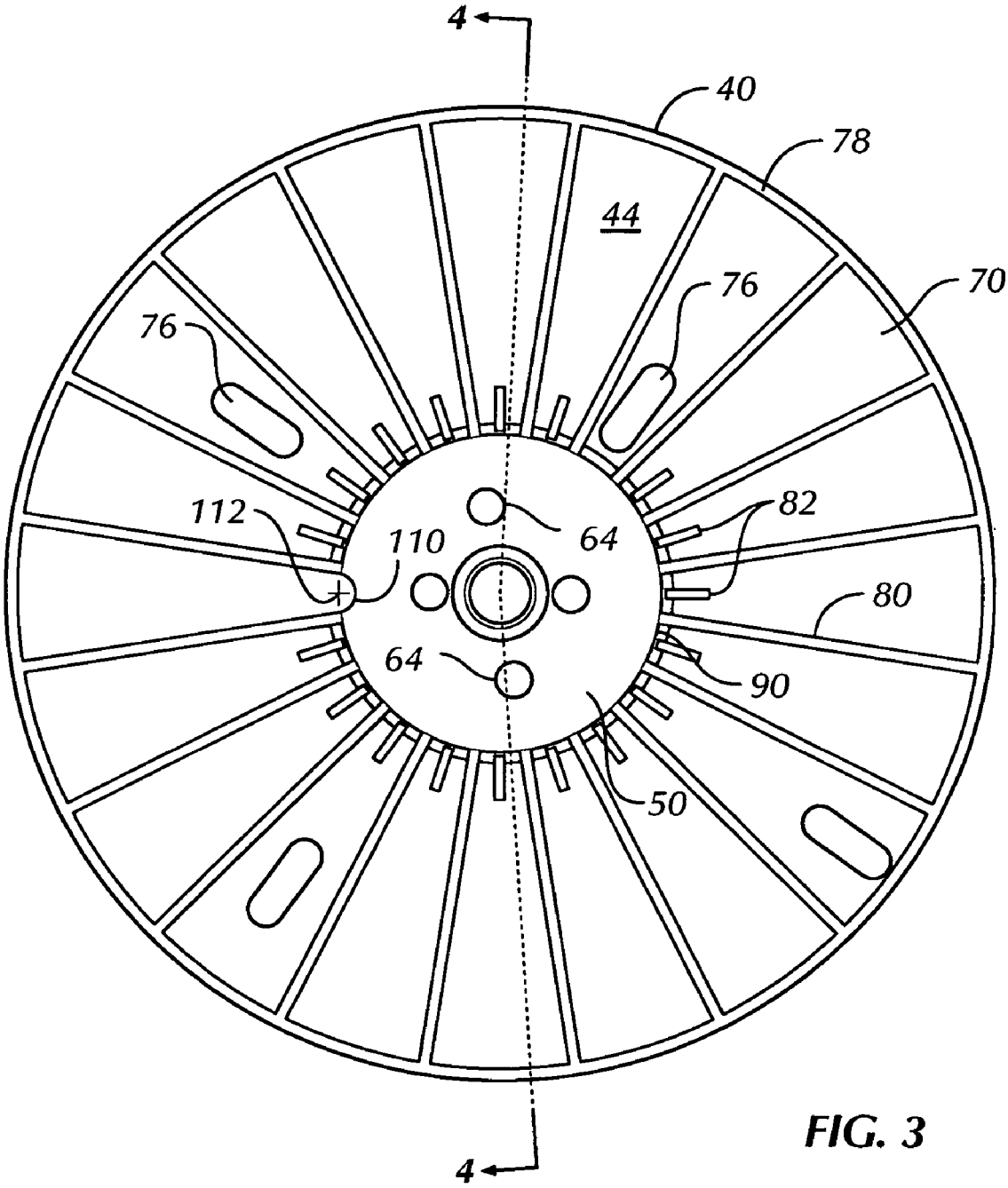
FIG. 3 is a plan view of an exterior face of a flange of the shipping spool of FIGS. 1 and 2.
Figure 4:
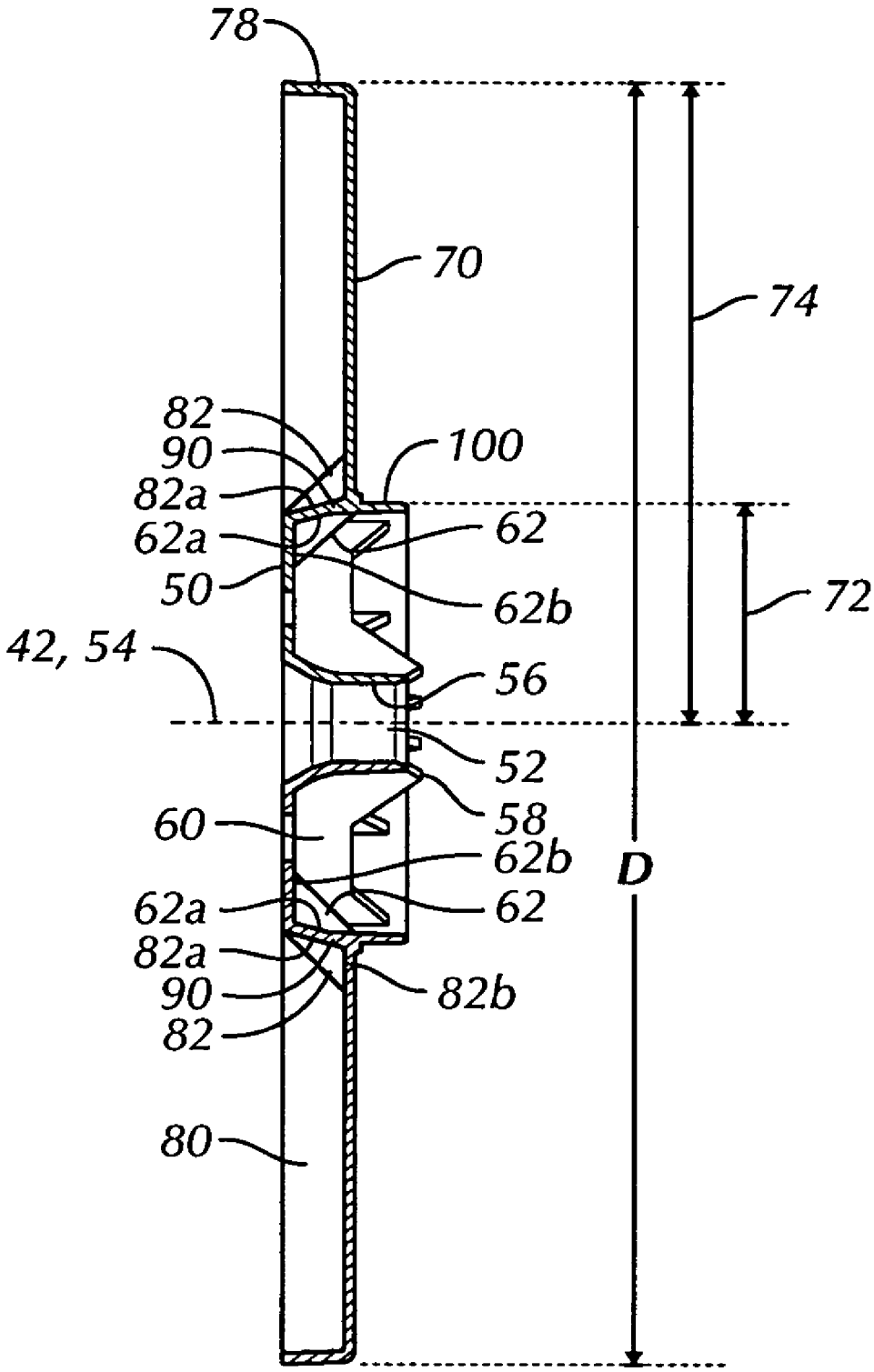
FIG. 4 is a cross-sectional view of the flange of FIG. 3, taken along line 4-4 of FIG. 3.
Figure 5:
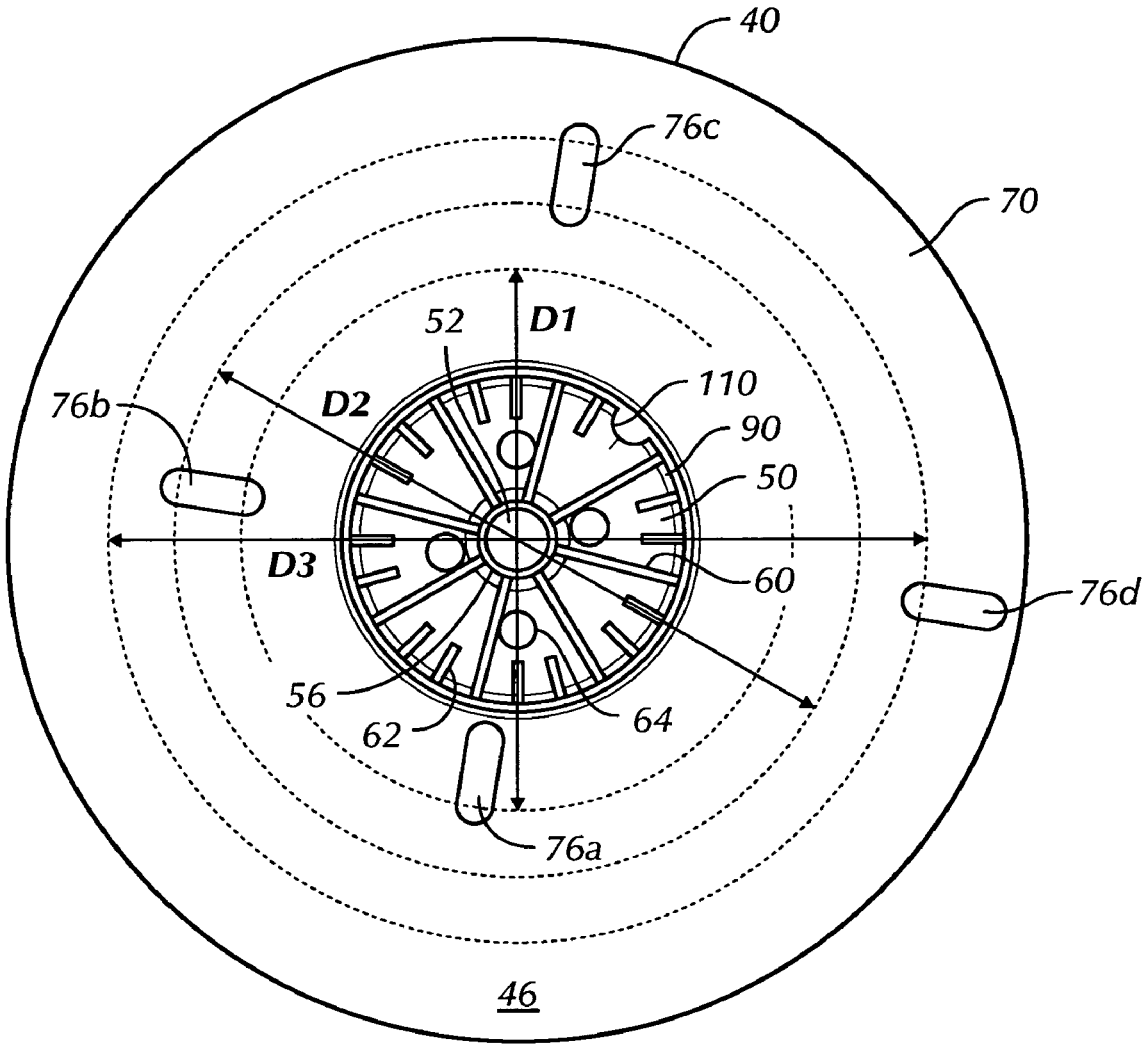
FIG. 5 is a plan view of an interior face of the flange of FIGS. 3 and 4.

Referring to the figures, wherein like numerals are used to indicate like elements throughout, there is shown in FIGS. 1-5 a preferred embodiment of a shipping spool in accordance with the present invention, indicated generally by the reference numeral 10. The spool 10 comprises a barrel 20 and two opposing end flanges 40 coupled to the barrel 20. With particular reference to FIGS. 1 and 2, the barrel 20 has a first end 22, a second end 24, a longitudinal centerline 26 and an outer surface 28 located at a first radius 30 from the centerline 26. The barrel 20 is preferably fabricated from conventional polymeric materials, such as acrylonitrile butadiene styrene or styrene, using conventional manufacturing techniques such as injection molding or extrusion. Preferably, the barrel is coupled to flanges 40 using conventional adhesive solvents or ultrasonic welding.

With particular reference now to FIGS. 2-5, the opposing end flanges 40 are identical. Each flange 40 has a hub portion 50 and an annular rim portion 70. Preferably, the hub portion 50 is connected to the annular rim portion 70 by a circumferential wall 90. The flanges 40 are preferably generally disk-shaped, having a central axis 42 which is generally coincident with the barrel longitudinal centerline 26 when the flanges 40 are assembled with the barrel 20. Each flange 40 has a first face 44 and a second face 46. When assembled with the barrel 20, the first face 44 is oriented away from the barrel 20, and thus may be characterized as an "exterior" face, while the second face 46 is oriented toward the barrel 20, and thus may be characterized as an "interior" face. In one preferred embodiment, the flanges 40 each have an outer diameter of approximately 14 inches (355 mm). The flanges 40 may have a diameter larger or smaller than 14 inches.

A central arbor hole 52 is preferably provided in the hub portion 50, formed by an arbor sleeve 56. The arbor hole 52 has an arbor hole centerline 54, which is generally coincident with the flange central axis 42. The arbor hole 52 is adapted to receive an arbor or spindle (not illustrated), upon which the spool 10 may be supported for rotation about the arbor hole centerline 54. A guide rib 58 preferably extends from the second face 46 in a divergent, radially expanding manner from the arbor sleeve 56 to form an opening larger than the arbor hole 54. The guide rib 58 may be formed as a continuous ring member, or, as illustrated, may include a plurality of outwardly extending protrusions, each protrusion extending from a plurality of hub radial ribs 60. When the spool 10 is fully assembled, a spindle (not illustrated) is first inserted from the side of the exterior face 44 through the arbor hole 54 in one of the flanges 40. The spindle must then be inserted "blindly" from the side of the interior face 46, through the arbor hole 54 in the second opposing flange 40. The guide rib 58, with its expanded opening, tends to help guide the spindle through the arbor hole 54 in the second opposing flange 40 during the blind insertion process.

Further preferably, the plurality of hub radial ribs 60 is provided, located on the second face 46 and fixed to the hub portion 50, arbor sleeve 56, and circumferential wall 90, extending between the arbor sleeve 56 and the circumferential wall 90. In the preferred embodiment illustrated, eight hub radial ribs 60 are provided. Alternatively, more or fewer hub radial ribs 60 could be provided. A plurality of hub angle brace ribs 62 may also be provided, located on the second face 46 and fixedly connected along a first edge 62*a* to the circumferential wall 90 and along a second edge 62*b* to the hub portion 50. The hub portion 50 may include a plurality of drive holes 64, sized, shaped, and positioned to receive drive members of winding machines. A collar 100 may be provided on the second face 46, extending from the circumferential wall 90, the collar 100 being sized and shaped to receive either of the barrel ends 22, 24.

The annular rim portion 70 has a radial span extending from an inner radius 72 to an outer radius 74, the inner and outer radii 72, 74 each extending from the flange centerline 42. The inner radius 72 is substantially equal to the first radius 30. Preferably, a circumferential rib 78 is fixed to the annular rim portion 70 on the first face 44 and extends around the annular rim portion 70 proximate the outer circumference of the annular rim portion. A plurality of annular rim radial ribs 80 may be fixed to the annular rim portion 70, the circumferential wall 90 and the circumferential rib 78 on the first face 44, the plurality of annular rim radial ribs 80 extending between the circumferential wall 90 and the circumferential rib 78. In the embodiment illustrated, twenty annular rim radial ribs 80 are provided, but alternatively more or fewer ribs could be provided. A plurality of annular rim angle brace ribs 82 may be provided, located on the first face 44 and fixedly connected along a first edge 82*a* to the circumferential wall 90 and along a second edge 82*b* to the annular rim portion 70.

Each flange 40 further comprises a plurality of openings 76, which are each positioned at a different angular and radial location within the annular rim portion 70, and which allow visual access to material wound on the spool 10. The plurality of openings 76 are sized such that if the plurality of openings 76 were rotated into angular alignment, the openings 76 would extend over substantially the entire radial span of the annular rim portion. Stated differently, and with particular reference to FIG. 5, which illustrates a preferred embodiment having four openings 76, positioned at angular locations spaced approximately 90 degrees apart, a first circle having a diameter D1 intersects both a radially innermost opening 76*a* as well as a radially second-inner-most radially opening 76*b*. Likewise, a second circle having a diameter D2 intersects both the radially second-inner-most opening 76*b*, as well as a radially second-outer-most opening 76*c*. Still further, a third circle having a diameter D3 intersects both the radially second-outer-most opening 76*c* as well as a radially outermost opening 76*d*. Thus, if the openings 76*a*-76*d* were rotated into radial alignment, the openings would overlap, and form a single opening that would extend over substantially the entire radial span of the annular rim portion 70. It will be understood that providing a plurality of relatively small openings 76 at various circumferential positions is desirable from a structural standpoint, allowing visual access to the spool contents over substantially the entire radial span of the annular rim portion 70, while reducing the flexibility that would be introduced into the flange 40 if a single, larger opening were used in place of the multiple, smaller openings 76.

Alternative approaches to providing visual access to materials wound on the spool 10 are possible. Rather than providing a plurality of openings 76, a single opening (not illustrated), combined with a transparent window (not illustrated) connected to the opening, could also be used. The single opening (not illustrated) would be located within the annular rim portion and have a size extending substantially between the circumferential wall 90 and the circumferential rib 78. A substantially transparent window (not illustrated) would be connected to the opening. The problem of increased structural flexibility resulting from the a single relatively large opening would be mitigated by providing the window. The transparent window and the remainder of the flange 40 could be joined during fabrication by conventional co-molding techniques.

As another alternative approach to providing visual access, at least a sector of the entire annular rim portion 70 could be fabricated from a substantially transparent polymeric material. Preferably, the entire annular rim portion 70, or the entire flange 40, could be fabricated from a transparent polymeric material such as a transparent form of acrylonitrile butadiene styrene.

The spool 10 is typically used in conjunction with a winding machine (not illustrated) having a winding dog (not illustrated). To facilitate operation of the spool 10 with the winding machine (not illustrated), the spool 10 may further comprise a generally semi-circularly shaped recess 110 formed in the circumferential wall 90 and located between two adjacent hub radial ribs 60, proximate the intersection of the ribs 80 and the hub portion 50. The semi-circular recess 110 has a center 112 positioned in the range of 2.2 to 2.4 inches from the flange centerline 42 and is sized and shaped to receive the winding dog (not illustrated). The semi-circular recess 110 provides a winding dog receptacle which maintains a continuous, unbroken circumferential wall 90. Thus, the recess 110 imposes only a minimal effect on the structural stiffness characteristics of the flange 40. Alternatively, if as an alternative design, a dog hole were to break the circumferential wall 90, the flange stiffness characteristics would be substantially degraded.

Preferably, each flange 40 is fabricated from a polymeric material, such as acrylonitrile butadiene styrene (ABS), and the hub portion 50 and the annular rim portion 70 each preferably have a wall thickness in the range of 0.10 to 0.14 inches. The flanges 40 are preferably fabricated using conventional manufacturing techniques such as injection molding.

The present invention may be embodied in other specific forms without departing from the spirit or essential attributes thereof and, accordingly, reference should be made to the appended claims, rather than to the foregoing specification, as indicating the scope of the invention.

A shipping spool or reel is thus disclosed, providing a novel arrangement of openings in the spool flange to provide visual access to the spool contents while also providing the flange with desirable structural stiffness characteristics. Furthermore, the spool provides a novel dog hole design which receives a winding dog while maintaining a high level of structural rigidity.

Although the invention has been described and illustrated with respect to the exemplary embodiments thereof, it should be understood by those skilled in the art that the foregoing and various other changes, omissions and additions may be made therein and thereto, without parting from the spirit and scope of the present invention. Accordingly, reference should be made to the appended claims, rather than to the foregoing specification, as indicating the scope of the invention.

What is claimed is:

1. A spool comprising:

a barrel having a first end, a second end, a longitudinal centerline and an outer surface located at a first radius from the centerline;

first and second end flanges each having a hub portion and an annular rim portion, the annular rim portion having a radial span extending from an inner radius to an outer radius, the inner and outer radii each extending from a flange centerline and the inner radius being substantially equal to the first radius and each flange being fixedly coupled at the hub portion to the barrel at the first and second ends, respectively; and a plurality of openings extending completely through the flange, each opening positioned at a different angular and radial location within the annular rim portion with only one opening disposed at each radial location on the flange, the openings sized such that they combine to extend over substantially the entire radial span of the annular rim portion.

2. The spool of claim 1, wherein four openings are provided and positioned at angular locations spaced approximately 90 degrees apart.

3. The spool of claim 1, each of the first and second flanges further having:

a first face and a second face;

a circumferential rib fixed to the annular rim portion on the first face and extending around the annular rim portion proximate an outer circumference of the annular rim portion;

a circumferential wall connecting the hub portion to the annular rim portion; and a first plurality of radial ribs fixed to the annular rim portion, the circumferential wall and the circumferential rib on the first face, extending between the circumferential wall and the circumferential rib.

4. The spool of claim 3 further comprising a collar on the second face extending from the circumferential wall, the collar being sized and shaped to receive an end of the barrel.

5. The spool of claim 3, further comprising a first plurality of angle brace ribs located on the first face and fixedly connected along a first edge to the circumferential wall and along a second edge to the annular rim portion.

6. The spool of claim 3, wherein the hub portion includes a central arbor hole formed within an arbor sleeve and a second plurality of radial ribs located on the second face and fixed to the hub portion, arbor sleeve, and circumferential wall, extending between the arbor sleeve and the circumferential wall.

7. The spool of claim 6 further comprising a second plurality of angle brace ribs located on the second face and fixedly connected along a first edge to the circumferential wall and along a second edge to the hub portion.

8. The spool of claim 6 further comprising a guide rib extending from the arbor sleeve and forming an opening larger than the arbor hole.

9. The spool of claim 6, wherein each flange is fabricated from a polymeric material and the hub portion and the annular rim portion each have a wall thickness in the range of 0.10 to 0.14 inches, the first plurality of radial ribs includes a total of twenty radial ribs, the second plurality of radial ribs includes a total of eight radial ribs, and each flange has an outer diameter of approximately 14 inches.

10. The spool of claim 1 for use with a winding machine having a winding dog, the spool further comprising a generally semi-circularly shaped recess formed in the circumferential wall and located between two adjacent radial ribs, proximate the intersection of the ribs and the hub portion, the semi-circular recess having a center positioned in the range of 2.2 to 2.4 inches from the flange centerline and being adapted to receive the winding dog.

11. The spool of claim 1, wherein each angular location has no more than one opening disposed thereon.

12. The spool of claim 1, wherein each opening defines an open passageway.

13. A spool for use with a winding machine having a winding dog to rotate the spool, the spool comprising:

a barrel having a first end and a second end;

first and second end flanges coupled to the barrel first and second ends, respectively, and each flange having a hub portion and a radially-extending, annular rim portion;

a first face and a second face;

a circumferential rib fixed to the annular rim portion on the first face and extending around the annular rim portion proximate an outer circumference of the annular rim portion;

a circumferential wall connecting the hub portion to the annular rim portion; and a first plurality of radial ribs fixed to the annular rim portion, the circumferential wall and the circumferential rib on the first face, extending between the circumferential wall and the circumferential rib; and a generally semi-circularly shaped recess located between two adjacent radial ribs, proximate the intersection of the ribs and the hub, the semi-circular recess having a center positioned in the range of 2.2 to 2.4 inches from the flange centerline and being adapted to receive the winding dog; and a plurality of openings in the flange, each opening allowing visual access through the flange and each opening positioned at a different angular and radial location within the annular rim portion with only one opening disposed at each radial location on the flange, the openings sized such that they combine to extend over substantially the entire radial span of the annular rim portion.

14. The spool of claim 13, the radial ribs having a height, wherein the recess has a depth substantially equal to the height of the radial ribs.

15. The spool of claim 13, wherein one and only one recess is provided in each flange.

16. The spool of claim 13, wherein the semi-circular recess has a radius in the range of 0.25 to 0.35 inches.

* * * * *